United States Patent [19]

Küker et al.

[11] Patent Number: 4,690,067

[45] Date of Patent: Sep. 1, 1987

[54] DEVICE FOR INTERCONNECTING A PORTAL PASSAGEWAY BETWEEN TWO RAIL VEHICLES

[75] Inventors: Wolfgang Küker; Heinz Findeklee, both of Salzgitter, Fed. Rep. of Germany

[73] Assignee: Linke-Hofmann-Busch, Fed. Rep. of Germany

[21] Appl. No.: 732,427

[22] Filed: May 9, 1985

[30] Foreign Application Priority Data

May 19, 1984 [DE] Fed. Rep. of Germany ..... 3418679

[51] Int. Cl.[4] ..... B61D 17/20; B60D 5/00

[52] U.S. Cl. ..... 105/3; 105/8.1; 105/458

[58] Field of Search ..... 105/8 R, 9, 15, 458, 105/3, 4 R, 8.1, 4.1

[56] References Cited

U.S. PATENT DOCUMENTS

| | | | |
|---|---|---|---|
| 3,922,971 | 12/1975 | Maroshick | 105/8 R |
| 4,252,065 | 2/1981 | Bickel et al. | 105/8 R |
| 4,405,143 | 9/1983 | Rosenkrands | 105/8 R |
| 4,458,911 | 7/1984 | Chadwick et al. | 105/8 R |

FOREIGN PATENT DOCUMENTS

| | | |
|---|---|---|
| 2757201 | 6/1979 | Fed. Rep. of Germany . |
| 3233794 | 3/1984 | Fed. Rep. of Germany . |

*Primary Examiner*—Robert B. Reeves
*Assistant Examiner*—David F. Hubbuch
*Attorney, Agent, or Firm*—McGlew and Tuttle

[57] ABSTRACT

An intermediate portal protecting an intercommunicating gangway between two coupled vehicles, particularly railroad cars. The portal comprises two mirror-symmetrical parts which are detachably connected to each other. The portal is closed on all sides and mounted for lateral displacement relative to the cars. On a straight track, the portal contour is flush with the contour of the cars. The parting surfaces between the portal and the respective car are designed to maintain a definite narrow gap therebetween under any operating conditions, as long as a supporting and guiding structure can follow these parting surfaces in parallel motion. To this end, the invention provides a supporting and guiding arm by which the portal is guided both horizontally and vertically by means of cam tracks conformable to the parting surfaces which are preferably spherical.

9 Claims, 4 Drawing Figures

DEVICE FOR INTERCONNECTING A PORTAL PASSAGEWAY BETWEEN TWO RAIL VEHICLES

FIELD AND BACKGROUND OF THE INVENTION

This invention relates in general to the construction of passageways between two operating vehicles and in particular to a new and useful mechanism for interconnecting portal passageway portions of a rail vehicle maintaining cooperating parting surfaces at equal spacing.

German OS No. 32 33 794 discloses a flush protective structure for thru-communication between cars connected by central buffer couplers, comprising an all-round closed portal which, on a straight track, has a contour aligned with the cars. The parting surfaces between the cars and the portal are spherical and the gap therebetween is bridged by a resilient sealing cover. The portal comprises two similar parts which are detachably connected to each other and to the horizontally pivotal central buffer couplers. While negotiating curves, the central line of the couplers ceases to be aligned with the central line of the portal, and becomes offset in parallel. That is why the portal must be mounted on the coupler for lateral displacement. Such a mechanism is expensive and raises problems of space and sealing.

German Pat. No. 27 57 201 (U.S. Pat. No. 4,252,065) discloses an intercommunication structure between railroad cars. A supporting structure therefore is formed by a bridge guide construction with a support on the car body side, connected in the manner of a universal joint. This construction supports a bridge part at the car body side and guides a lengthwise telescoping bridge support at the portal side which is connected to the associated portal part in the manner of a spherical joint. A lengthwise resilient ball-and-socket coupling rod connected to the car body guides the associated portal part along in the lengthwise and transverse directions. If it is desired or required to keep the load of the portal off the couplers, the load may be taken up by an upper guide system comprising a roller chain mechanism. In such an instance, two supporting arms of the structure form a rigid yoke which is suspended by both its ends from two slides which are guided in the longitudinal direction by the pivotal arms mounted for swinging about a vertical axis. Hinged to the slides is a single or double supporting arm which is pivotable about a transverse axis and detachably jointed to the respective part of the portal. This prior art system is not capable of guiding the portal in all degrees of freedom to maintain a definite gap at the parting surfaces between the portal and the car, particularly if the parting surfaces are spherical and the gap is protected by a resilient sealing cover which cannot be loaded.

SUMMARY OF THE INVENTION

The invention is directed to a jointing construction for both supporting railway car portal and for making it possible to accurately guide the portal relative to the car end, i.e. to guide it while maintaining a predetermined gap between the respective parting surfaces.

Accordingly, it is an object of the invention to provide for interconnecting a portal passageway between two rail vehicles which include a portal and an engagement member connected to an end of one of the cars which have curved opposed parting surfaces and which includes means for articulating the portal and member so that the surfaces are maintained at proper spacing.

A further object of the invention is to provide a device for interconnecting portal passageways between vehicles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
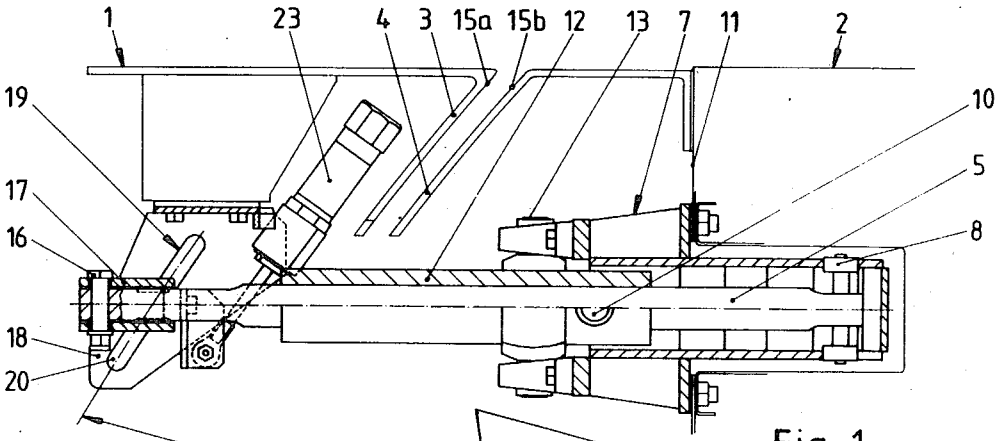
FIG. 1 is a longitudinal sectional view of the supporting and guiding arm showing how the arm is connected to both the portal and the car end and constructed in accordance with the invention.

Referring to the drawings in particular the invention embodied therein comprises a device for interconnecting operating portal passageways or assemblies between two rail vehicles so as to maintain parting surfaces 15*a* and 15*b* in a predetermined relative relationship during opeation of the vehicle. Parting surface 15*a* is on a portal 1 between two cars and parting surface 15*b* is on an end of one of the cars 2, only one car 2 and the right hand portion of portal 1 is shown in FIG. 4 while FIG. 3 shows only the upper parts of the portal assembly.

Figure 2:
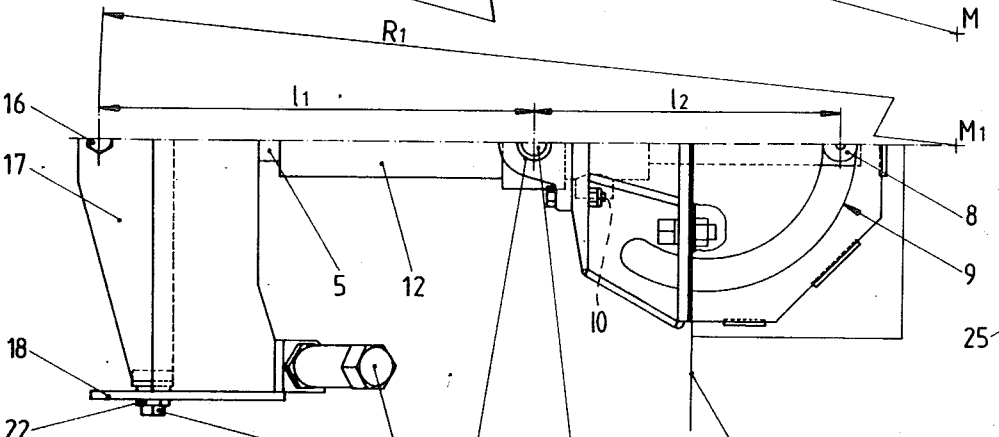
FIG. 2 is a top plan view of the device shown in FIG. 1.
Figure 3:
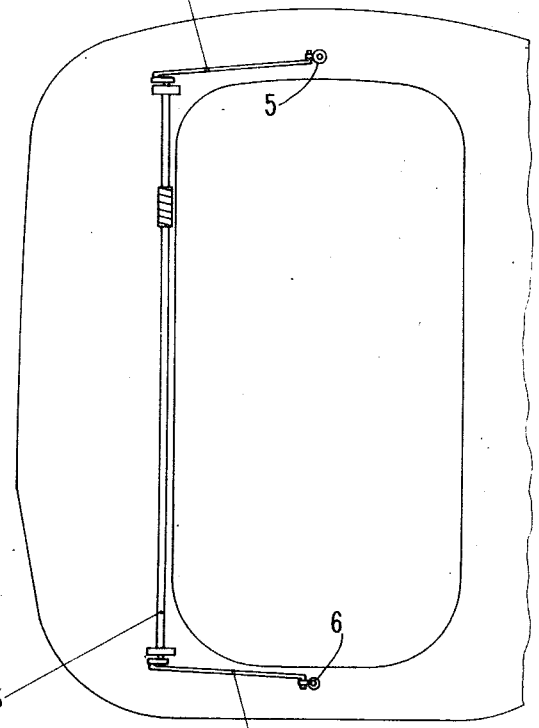
FIG. 3 is a side elevational view of an upper part of the portal assembly, showing the transverse links and the coupling rod.
Figure 4:
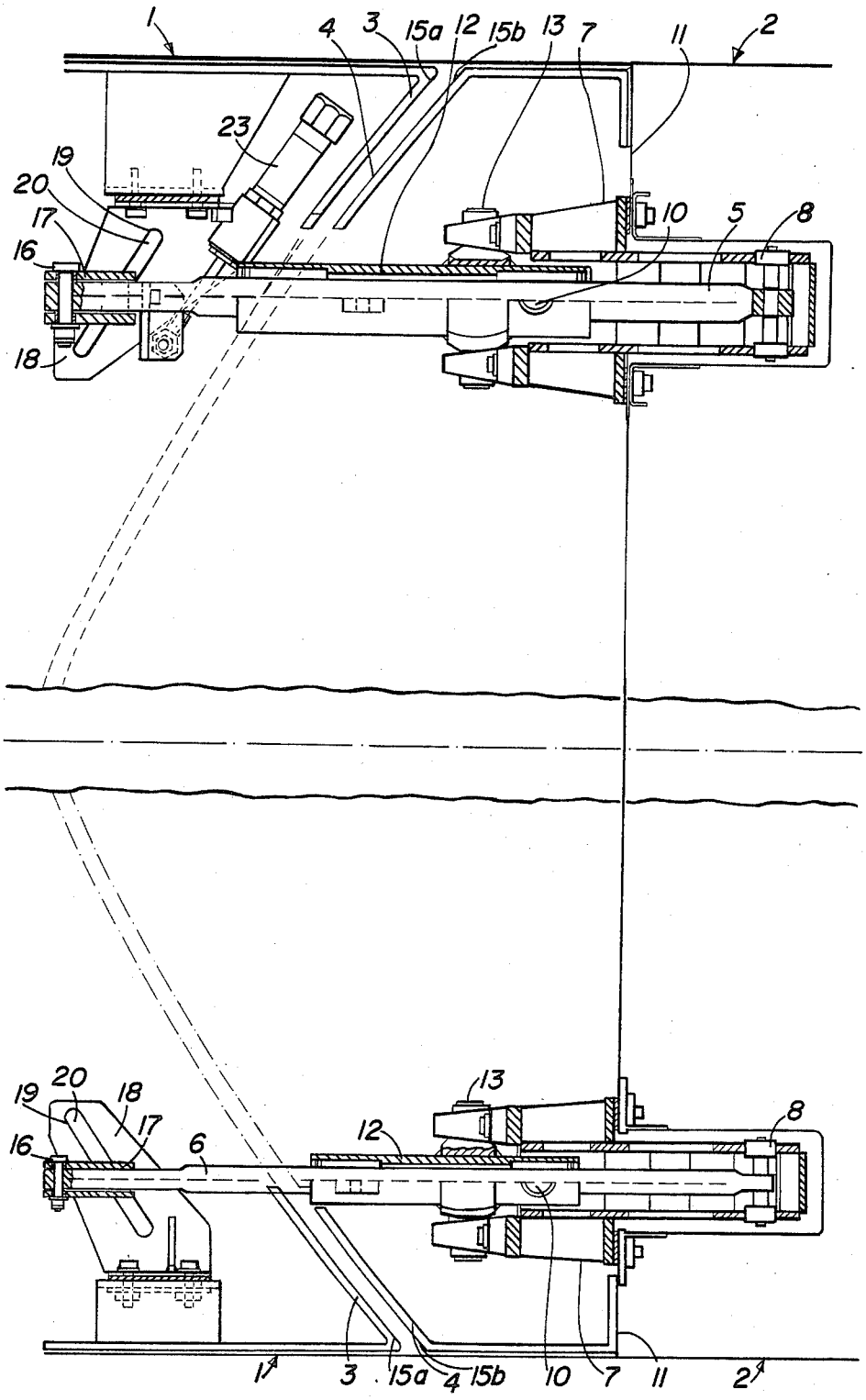
FIG. 4 is a view similar to FIG. 3, showing mirror symmetrical upper and lower parts of the portal assembly.

The portal 1 as shown in FIGS. 3 and 4 comprises, on its end facing the car 2, an abutment member 3 extending along the entire periphery of the portal and having a contour and the parting surface 15*a* corresponding to an associated engagement member 4 provided on the end of the car 2 and having surface 15*b*. Both surfaces are designed as spherical portions having a common center at a point M (FIG. 3) situated in the lengthwise median plane indicated by a dash-dotted line in FIG. 2 where the projection of point M is designated $M_1$. The portal 1 is supported and guided by means of a carrying arm 5 at the top and a carrying arm 6 at the bottom so as to permanently maintain a constant narrow gap along the predetermined speherical parting surfaces 15*a*, 15*b* having slightly different radii and a common center of curvature M.

The carrying arm 5 is mounted, preferably above the passage opening, for lengthwise displacement and for horizontal pivoting about a fixed axis located intermediate its ends. The arm 5 is received in a guide sleeve 12 within which it is lengthwise displaceable. Sleeve 12 is mounted for horizontal pivoting on a bracket 7, by means of two opposite vertically aligned pivot pins 13 (extending respectively above and below sleeve 12) received in corresponding recesses 14 of the bracket 7.

Bracket 7 is fixed to the car end and projects to both sides of the car end wall 11. Engagement member 4 projects beyond end wall 11 and is fixed to this end wall.

Further provided in bracket 7 is.a curved guide 9 in which slide or roll elements, particularly rollers 8, that are carried on the car side end of arm 5, are engaged for positively guiding the arm in pivotal motion. Sleeve 12 is secured against rotation about its longitudinal axis by elements 10 which project from either side of the sleeve. Elements 10 (one is shown in dotted line in FIG. 2) ride beween parts of bracket 7 for this purpose. Curved guide 9 is conformed to the extension of parting surfaces 15*a*, 15*b* which are embodied by the surface of abutment member 3 and the engagement member 4, opposing each other. Guide 9 may simply be a curved slot in bracket 7. On its end remote from the car body, arm 5 carries a cross piece 17 which is mounted thereon for horizontal swinging, by means of a bolt 16. Cross piece 17 guides the up and down movement of arm 5, by means of sliding blockes 22 secured by screws 21, and guides 19 which are provided in a fixed frame 18 and preferably embodied by curved slots 20. Slots 20 are shaped to correspond to the extension of parting surfaces 15*a*, 15*b* and have a radius R centered at the common center of curvature M.

The shape of the guide 9 is of a design to reproduce an instantaneous definite radius $R_1$ through arm 5 in any deflected position between the car 2 and portal 1, in accordance with the lever arms ratio $1_1$ to $1_2$. Radius $R_1$ is the distance between center $M_1$ and the center of bolt 16 embodying the swinging axis of cross piece 17.

In other words, the shape of curved guide or slot 9 is selected so that when the portal 1 with its parting surface 15*a* swings its spherical motion about the car 2 with its parting surface 15*b*, a fixed gap is always maintained between parting surface 15*a* and 15*b*. This is because the opposite ends of the carrying arm 5 at the top, and the opposite ends of the carrying arm 6 at the bottom, are confined to move in a path defined by the curved guides on one side (through the rollers 8) and the curved guides 19 at the other side (through the bolt 16, cross pieces 17, sliding blocks 22 and slots 20). With this swinging movement, it is recalled that the intermediate portion of the carrying arms 5 and 6 is slidably carried by guide sleeves 12 which themselves are confined for pivotal movement about pins 13.

Frame 18 forms a part of portal 1 and props the portal against arm 5 through resilient and/or damping elements 23. The guide arm 6 at the bottom of the assembly extends below the passage opening and is similarly designed and mounted as arm 5. Arm 6 guides portal 1 in the same way as arm 5. Depending on the required conditions of oscillation and load distribution, guide arm 6 may be connected to portal 1 also through resilient or damping elements 23. In FIG. 4, which shows arm 6, all members designate similar parts as for the upper part of the assembly that center arm arm 5.

Hinged to each of arms 5 and 6 is a transverse link 24 which extends toward the contour line and is horizontally pivotable, with a vertically extending spring loaded coupling rod 25 connecting the ends of links 24.

While negotiating a curve, portal 1 between cars 2 is positively guided, in accordance with the spherical surfaces, into its position required by the geometry of the cars and the track, by means of the above described system of jointing.

While specific embodiments of the invention have been shown and described in detail to illustrate the application of the principles of the invention, it will be understood that the invention may be embodied otherwise without departing from such principles.

What is claimed is:

1. A device for interconnecting a portal passageway between two rail cars, comprising an engagement member connected to one end of one rail car, a portal mounted between the cars, said engagement member and portal having curved opposed parting surfaces with a common center of curvature and a selected gap width therebetween, a sleeve for guiding said parting surfaces pivotally said sleeve being mounted for pivotal movement to the one end of the one rail car and about a vertical axis spaced from said parting surfaces, a carrying arm axially movable in said sleeve, means for holding said sleeve against rotation to the one end of rhe one car, means on the one car for confining one end of said arm for arcuate movement in a horizontal plane, a cross piece mounted to the opposite end of said arm for pivotal movement about a vertical axis, a fixed frame connected to said portal and having a frame guide with a radius having the same center of curvature as said parting surfaces, said frame guide extending in a vertical plane and confining vertical movement of said cross piece, said frame guide and the arcuate movement to which said one end of said arm is confined having a shape for maintaining the selected gaps between said parting surface.

2. A device according to claim 1, wherein said means for confining one end of said arm comprises a bracket fixed to the one end of the one car and a curved bracket guide defined in said bracket, a slide element being connected to said one end of said arm for riding along said bracket guide.

3. A device according to claim 2, wherein said curved guide of said bracket comprises a slot for receiving said slide element, said frame guide comprising a pair of spaced apart curved slots extending in parallel vertical planes, said cross piece having a slide block at opposite ends thereof, each slide block of said cross piece being slidably mounted in one of said curved slots of said frame guide.

4. A portal assembly for the end of a rail car comprising:

an engagement member fixed to one end of the rail car and having a first spherical parting surface;

a portal having an abutment member with a second spherical parting surface spaced by a selected gap from said first parting surface, said first and second parting surfaces having the same center of curvature;

a guide bracket fixed to the one end of the rail car having a horizontally extending curved guide therein;

a frame fixed to said portal and having spaced apart vertically extending curved guides therein, each of said curved guides having the same center of curvature as said first and second parting surfaces;

a sleeve pivotally mounted about a vertical axis to the end of the car at a location spaced from said curved guide of said bracket;

a carrying arm extending through said sleeve for longitudinal movement in said sleeve, said carrying arm having opposite ends extending out of said sleeve, said sleeve being engaged around an intermediate portion of said carrying arm;

a guide following element connected to one end of said arm and movably mounted in said curved guide of said bracket for following said curved guide of said bracket with pivoting of said arm;

a cross piece pivotally mounted about a vertical axis to the opposite end of said arm, said cross piece having opposite ends;

a sliding block connected to each of said opposite ends of said cross piece, each sliding block being mounted for movement in and along one of said curved guides of said frame for vertical movement of said cross piece with respect to said frame; and means connected to said sleeve to prevent rotation of said sleeve about its longitudinal axis;

the shape of said curved guide and the location of said vertical axis about which said sleeve pivots being selected to maintain said selected gap between said first and second spherical parting surfaces.

5. A portal assembly according to claim 4, wherein said guide following element comprises a roller, said curved guide of said bracket comprising a slot, said roller being mounted in said slot for rolling therealong.

6. A portal assembly according to claim 4, wherein said curved guides of said frame comprise curved slots, each of said sliding blocks of said cross piece being mounted for sliding in one of said curved slots of said frame.

7. A portal assembly according to claim 4, including a resilient element connected between said portal and said cross piece for supporting said cross piece in an upward direction.

8. A portal assembly according to claim 4, including a second guide bracket fixed to the end of the car below said first-mentioned guide bracket, said second guide bracket having a second curved guide therein lying in a horizontal plane, a second frame fixed to said portal and positioned below said first-mentioned frame, said second portal having a pair of second spaced-apart curved guides having the same center of curvature as said first and second parting surfaces, said second curved guides of said second frame lying in vertical planes, a second sleeve pivotally mounted to said second bracket about a vertical axis, a second carrying arm mounted for longitudinal movement in said second sleeve, said second arm having opposite ends and said second sleeve being engaged around said second arm at an intermediate location thereon, a second guide following element connected to one end of said second arm and mounted for movement along said second curved guide of said second bracket, a second cross piece mounted for pivotal movement about a vertical axis to the opposite end of said second arm, second slide blocks connected to opposite ends of said second crosspiece each mounted for guiding along one of said second curved guides of said second frame.

9. A portal assembly according to claim 8, including a transverse link connected for pivoting about vertical axes to each of said first-mentioned and second arms, and a vertical coupling rod connected between said transverse links.

* * * * *